United States Patent [19]

Winner

[11] Patent Number: 4,587,865

[45] Date of Patent: May 13, 1986

[54] GAS FEED SAFETY DEVICE FOR AMPUTEES

[76] Inventor: Ralph Winner, 2242 King Ridge Rd., Pittsburgh, Pa. 15237

[21] Appl. No.: 214,468

[22] Filed: Dec. 8, 1980

[51] Int. Cl.[4] ..... G05G 1/16

[52] U.S. Cl. ..... 74/562.5

[58] Field of Search ..... 74/562, 562.5, 478.5, 74/564; 296/75; 297/423, 427; 180/90.6

[56] References Cited

U.S. PATENT DOCUMENTS

| | | | |
|---|---|---|---|
| 1,143,772 | 6/1915 | Moore | 180/90.6 |
| 1,247,996 | 11/1917 | Parker | 74/566 |
| 1,898,640 | 2/1933 | Moss | 248/230 |
| 2,174,419 | 9/1939 | Holtzclaw | 74/562.5 |
| 2,507,807 | 5/1950 | Newbern | 180/90.6 |
| 2,618,171 | 11/1952 | Curtis | 74/564 |
| 3,108,489 | 10/1963 | Self | 74/562.5 |
| 3,543,606 | 12/1970 | Kaul | 74/562.5 |
| 3,784,247 | 1/1974 | Mills | 296/75 |
| 4,010,975 | 3/1977 | Horton | 296/75 |

FOREIGN PATENT DOCUMENTS

| | | | |
|---|---|---|---|
| 490898 | 3/1953 | Canada | 74/564 |
| 2610525 | 9/1977 | Fed. Rep. of Germany | 74/478.5 |

*Primary Examiner*—Kenneth J. Dorner

*Attorney, Agent, or Firm*—Buell, Ziesenheim, Beck & Alstadt

[57] ABSTRACT

A gas feed safety device for right leg amputees is provided in the form of a socket member adapted to be attached to the floor or hump of an automobile and an elongate stop member having a depending arm adapted removably to fit in said socket member to hold the foot stop member spaced above an accelerator pedal and to hold said member rigidly in place.

5 Claims, 3 Drawing Figures

GAS FEED SAFETY DEVICE FOR AMPUTEES

This invention relates to gas feed safety devices for amputees and particularly to a gas feed safety device for right leg amputees.

Modern technology has provided several gas feed arrangements by which a right leg amputee may drive an automobile having an automatic transmission using only his left leg to operate the brake and gas feed, without affecting the usability of the vehicle by persons having two legs and operating the vehicle in the usual manner. This is generally accomplished by providing an auxiliary gas feed, to the left of the brake pedal, which is hinged to the floor of the vehicle. The auxiliary gas feed may be slidable transversely of the normal gas pedal so that it can be deactivated or it may be permanently fixed. In the first case, there is a danger of the auxiliary feed sliding sidewise and becoming disengaged from the normal gas pedal during operation by the amputee. This is disconcerting and in some cases may be dangerous. Another and perhaps more serious problem faced by the right leg amputee is the ever present danger that the right leg prosthesis will unknowingly come to rest on the normal gas feed so that control of speed of the vehicle is lost. This latter situation has resulted in serious accidents and near accidents and, to my knowledge, has remained unsolved. In most vehicles the drive shaft tunnel or hump is too high to provide either a safe or comfortable resting place for the prosthesis.

I have invented a safety device which can prevent both of these occurances. I have discovered a foot rest arrangement which will prevent the right leg prosthesis from interfering with the operation of the gas pedal and at the same time will stabilize the auxiliary feed so that it will not move out of position on the gas pedal of the car. The device of the invention is readily removable from the vehcile so that the vehicle may be operated by a person with two normal legs.

I provide a socket member adapted to be attachable to the floor or hump of an automobile, an elongate foot stop member having a depending arm adapted removably to fit in said socket member to hold the foot stop member spaced above an accelerator arm or pedal and to hold the same rigidly in place and removable transverse guide means extending from the foot stop member alongside but spaced from the accelerator to guide and retain an auxiliary accelerator arm. Preferably the socket member has a rectangular socket opening and the depending arm on the foot stop member has a like rectangular section to fit tightly therein. The foot stop member is preferably provided with a plurality of threaded openings spaced apart along its length at the end remote from the depending arm to receive the threaded end of the removable guide means. The guide means is preferably a steel rod threaded at one end.

In the foregoing general description, I have set out certain objects, purposes and advantages of this invention. Other objects, purposes and advantages of this invention will be apparent from a consideration of the following description and the accompanying drawings in which.

Figure 1:
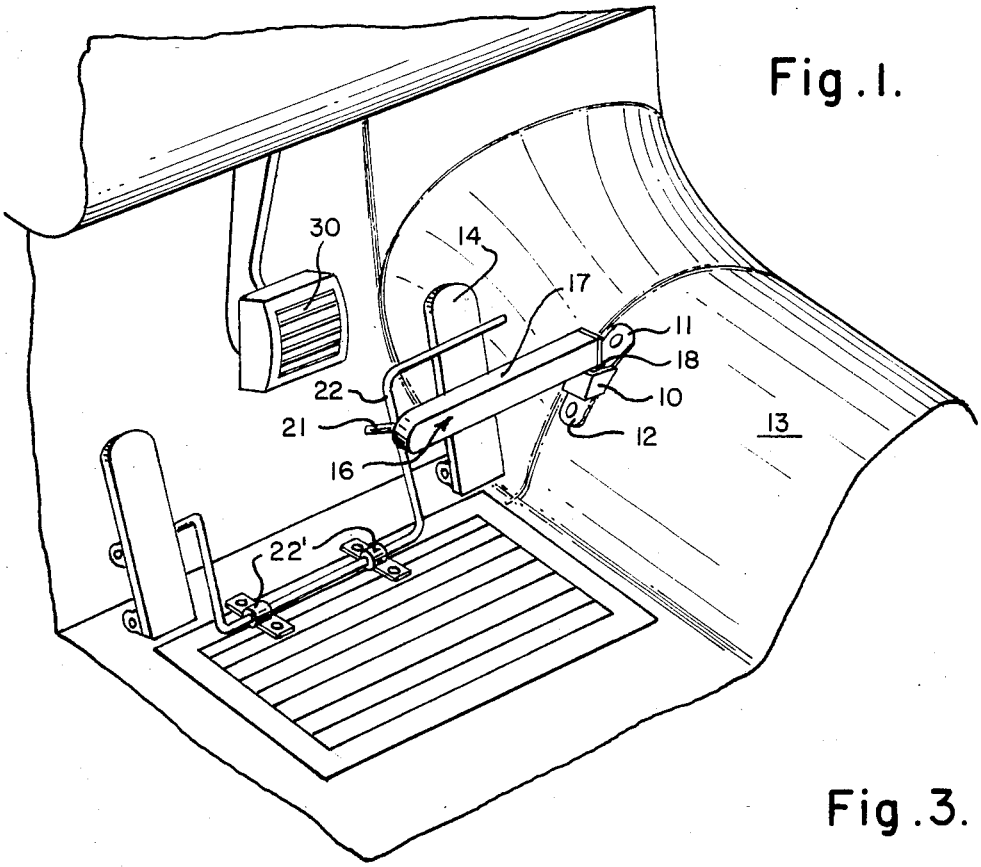
FIG. 1 is an isometric view of a gas feed safety device according to this invention installed in an automobile.
Figure 3:
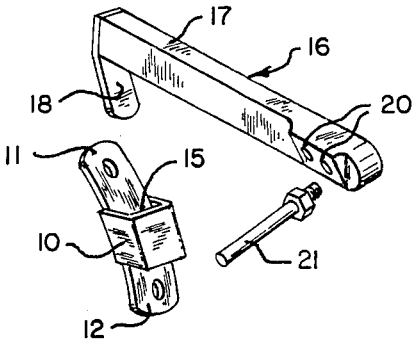
FIG. 3 is an exploded view of the gas feed safety devcie of FIG. 1.
Figure 2:
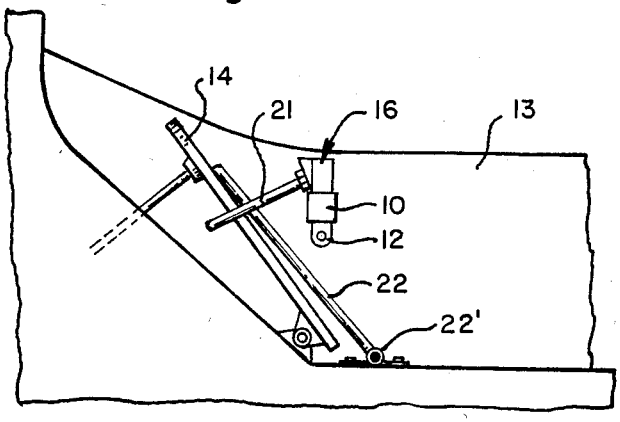
FIG. 2 is an end elevational view of the gas feed safety device of FIG. 1.

Referring to the drawings I have illustrated a gas feed safety device for right leg amputees in which a socket member 10 having tabs 11 and 12 is fastened to the hump 13 of an automboile floor alongside an accelerator pedal 14. A foot stop member 16 in the form of an elongate metal bar 17 having a dependent arm 18 is removably attached to the socket member 10 by inserting arm 18 into socket opening 15 in socket member 10. Arm 18 and socket opening 15 have interfitting generally rectangular cross sections which hold the stop member rigidly in place when the vehicle is being used by an amputee but permit ready removal of the foot stop member 16 when the vehicle is used by one other than the amputee. A plurality of spaced threaded openings 20 are formed in the end of stop member 16 to receive guide 21 therein. Guide 21 acts to prevent sidewise movement of auxiliary gas feed 22 which is provided for use by a right leg amputee to actuate the accelerator pedal 14 by means of the left foot. The gas feed 22 may be any of several well known types. A typical auxiliary gas feed is illustrated having a generally V-shape with the bottom of the V journaled in spaced journals 22' fastened to the floor of the automobile beneath the brake pedal.

In operation by a right leg amputee, the foot step member 16 is inserted over the accelerator pedal 14 with arm 18 firmly in socket opening 15. The right leg prosthesis can now be rested on foot stop member 16 without interfering with accelerator pedal 14. The auxiliary gas feed 22 is properly positioned over the accelerator pedal 14 and guide 21 placed in the proper opening 20 to retain auxiliary gas feed 22 from sidewise movement in journals 22'. The automobile can now be driven by the right leg amputee using his left foot to operate the auxiliary accelerator or gas feed 22 and conventional brake 30.

In the foregoing specification I have set out certain preferred embodiments and practices of my invention, however, it will be understood that this invention may be otherwise embodied within the scope of the following claims.

I claim:

1. A gas feed safety device for right leg amputees for use in conjunction with a left foot accelerator device coupled to a normal accelerator pedal comprising a socket member adapted to be attached to the floor or hump of an automobile on one side of an accelerator pedal and an elongte foot stop member having a depending arm at one end adapted removably to fit in said socket member to hold the foot stop member spaced above said normal accelerator pedal with the other end of said foot stop member extending beyond the other side of said accelerator pedal and to hold the same member rigidly in place, whereby the normal accelerator pedal is protected against contact by an artificial leg.

2. A gas feed safety device as claimed in claim 1 having removable transverse guide means extending from the said other end of the stop member alongside but spaced from the said other side of said accelerator pedal to guide and retain an auxiliary left foot actuated accelerator arm.

3. A gas feed safety device as claimed in claim 1 or 2 wherein the socket member has a rectangular socket opening and the depending arm has a like rectangular section to fit tightly therein.

4. A gas feed supply device as claimed in claim 1 or 2 wherein the said other end of the foot stop member remote from the depending arm is provided with a plurality of spaced threaded openings adjacent said other end of said foot stop member receiving a threaded end of a transverse guide means extending from said other end of the foot stop member alongside but spaced from said other side of said accelerator pedal to guide and retain an auxiliary left foot actuated accelerator arm.

5. A gas feed safety device as claimed in claim 4 wherein the guide means is a metal rod threaded at one end.

* * * * *

UNITED STATES PATENT AND TRADEMARK OFFICE

CERTIFICATE OF CORRECTION

PATENT NO. : 4,587,865

DATED : May 13, 1986

INVENTOR(S) : Ralph Winner

It is certified that error appears in the above-identified patent and that said Letters Patent is hereby corrected as shown below:

Column 2, line 2, change "devcie" to --device--.

Column 2, line 6, change "automboile" to --automobile--.

Column 2, line 28, change "step" to --stop--.

Column 2, line 51, change "elongte" to --elongate--.

Column 3, line 1, change "supply" to --safety--.

Signed and Sealed this

*Second* Day of *September 1986*

[SEAL]

*Attest:*

DONALD J. QUIGG

*Attesting Officer*

*Commissioner of Patents and Trademarks*